United States Patent [19]

Membrino

[11] 4,305,503

[45] Dec. 15, 1981

[54] PACKAGE OF PLASTIC BAGS

[76] Inventor: Hercules Membrino, 280 Paoli State Rd., Malvern, Pa. 19355

[21] Appl. No.: 143,318

[22] Filed: Apr. 24, 1980

[51] Int. Cl.[3] ..... B65D 85/62; B65D 30/00

[52] U.S. Cl. ..... 206/554; 206/526; 229/69

[58] Field of Search ..... 206/554, 526; 229/69

[56] References Cited

U.S. PATENT DOCUMENTS

| | | | |
|---|---|---|---|
| 460,472 | 9/1891 | Hitt | 229/69 |
| 1,170,590 | 2/1916 | Wheeler | 206/389 |
| 2,628,013 | 2/1953 | Vogt | 229/69 |
| 3,021,947 | 2/1962 | Sylvester et al. | 206/554 |
| 3,353,661 | 11/1967 | Membrino | 206/554 |

*Primary Examiner*—William T. Dixson, Jr.

*Attorney, Agent, or Firm*—Arthur A. Jacobs

[57] ABSTRACT

A pad of plastic bags comprising a plurality of bag units, one above the other, each unit comprising a pair of oppositely disposed open-mouthed pockets connected to a common spacer portion by score lines or the like at the mouth ends of the pockets, each pocket having a lip at its mouth end spaced from the respective score line, the multiple bag units being connected to each other at the spacer portions by a weld or other connection at each side of the spacer portions, the connected spacer portions forming a base for all the bag units in the pad, the side welds acting as an anchor means to resist the forward pull on the lip as a bag is torn away by grasping the lip and pulling forward, whereby the bag is substantially fully opened and severed from the base at the same time.

10 Claims, 9 Drawing Figures

FIG. 1
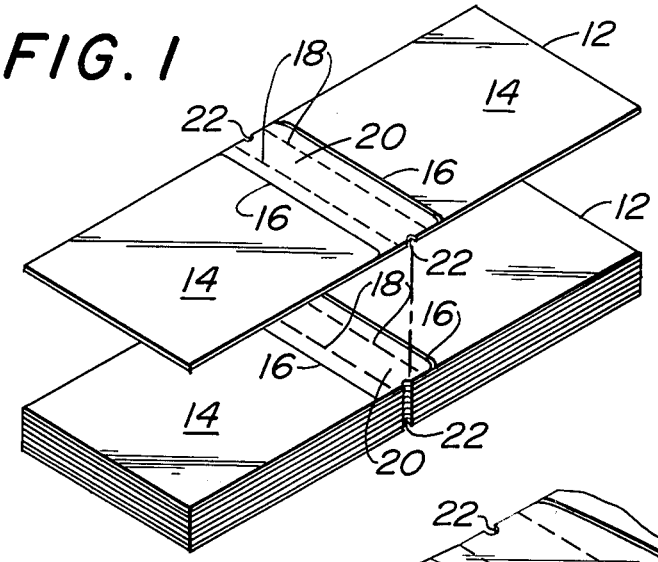
FIG. 2
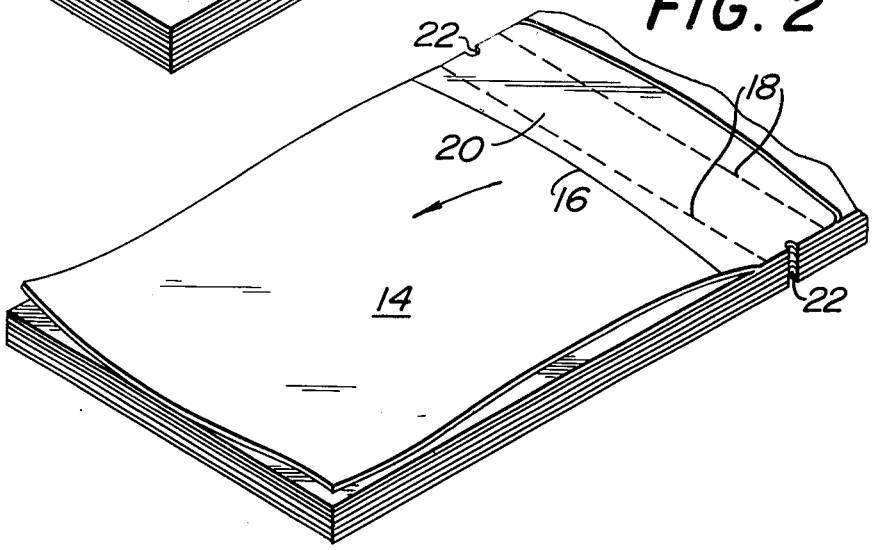
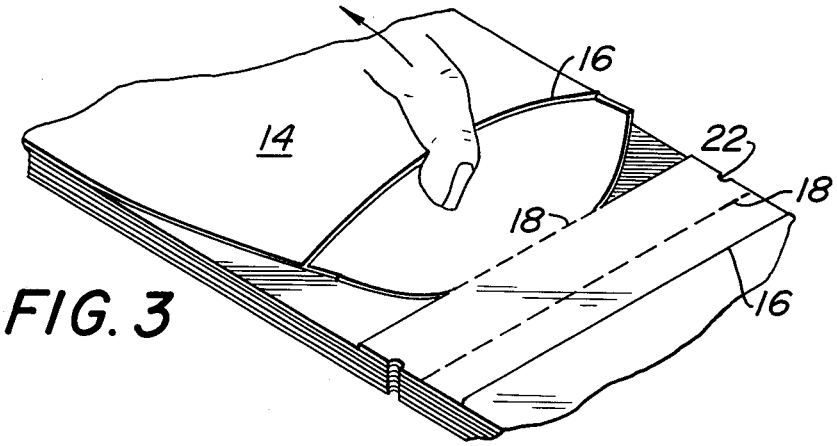
FIG. 3

FIG. 7
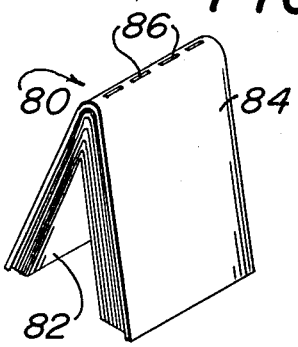
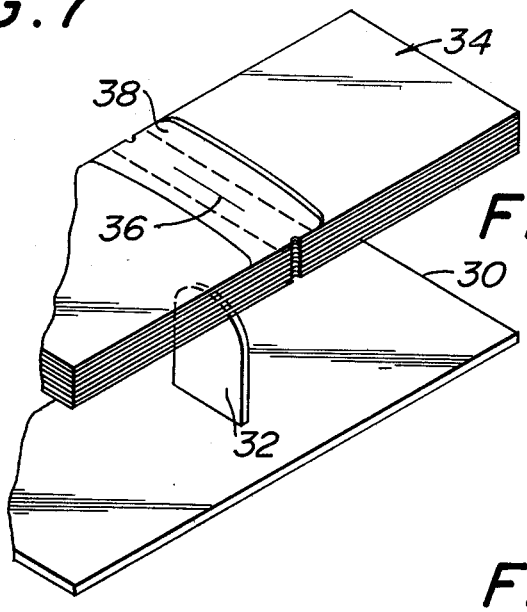
FIG. 4
FIG. 5
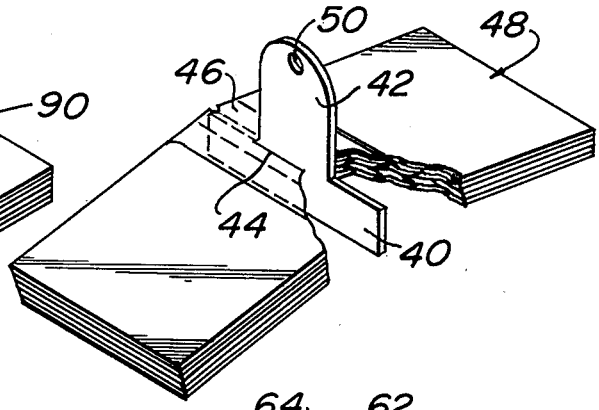
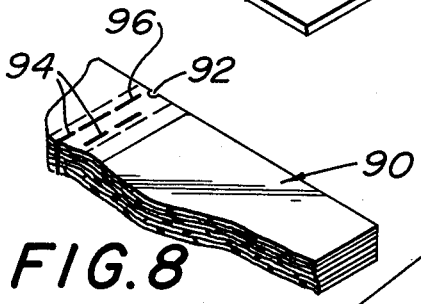
FIG. 8
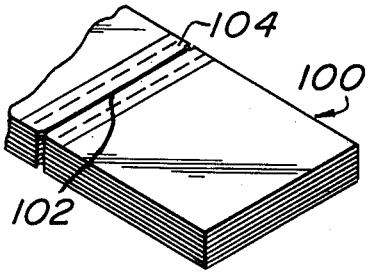
FIG. 9
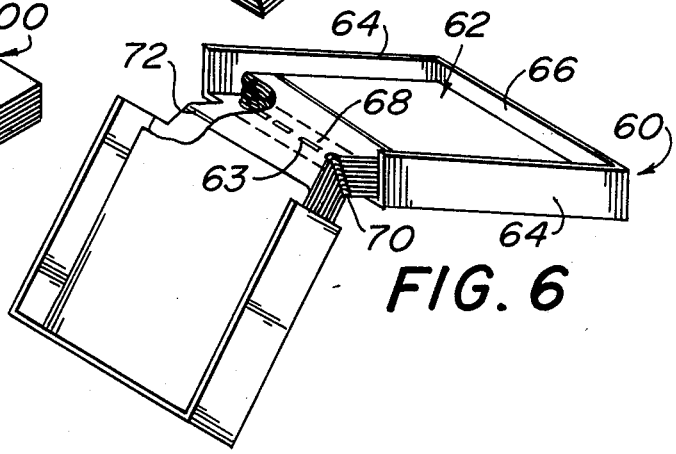
FIG. 6

PACKAGE OF PLASTIC BAGS

This invention relates to plastic bags, and it particularly relates to plastic bag units consisting of a pair of pockets which are formed on opposite sides of a base or spacer and are connected thereto by score lines or the like, whereby when a pocket is grasped adjacent its mouth and pulled forward, it will simultaneously both tear away from the spacer at the score line and open up at its mouth, at least one edge of which is defined by the score line, the result being an open-mouthed bag ready for use.

The above type of plastic bag unit is disclosed in U.S. Pat. No. 3,353,661, dated Nov. 21, 1967, and, essentially, the bag units of the present invention are the same and are made the same way as disclosed in the aforementioned patent, particularly as disclosed in the species of FIGS. 6–8 of that patent, wherein a lip is provided at the mouth.

The effectiveness of the above-described bag units is enhanced when they are used in a package assembly, wherein a plurality of bag units are arranged in overlying relationship with the spacer portions lying one over the other to form a base for the package.

Although the bag units disclosed in the aforementioned patent have proven very effective in use and easy and inexpensive to make, there has been a problem related to the ease of opening of the bags. Since these bags are made of plastic material such as polyethylene, the tendency of the walls of the bag to adhere to one another is quite great, and it has often been quite difficult to effect a complete opening of the bag by the simultaneous pulling and tearing action.

In accordance with the present invention, when the bag units are assembled in the aforementioned type of package, a substantially complete and rapid opening of the mouth of each individual bag is effected when the spacers, which combine to form the base of the entire package, are connected together, at each side, with a weld or similar connection.

This connection acts as an anchor means to provide a counterforce to the pulling action, whereby, when the lip of a bag pocket is pulled forwardly away from the package, the pulling action will not only sever the bag from its respective spacer at the score line but will completely open the bag.

In the above manner, by over-laying a number of bag units and then connecting the spacers of each to the other, the assembly becomes, in effect, a self-contained pad of self-dispensing bags. The pad may be held in the hand, without the necessity of using brackets, clamps, or other mechanical supports, to sever and open a bag—although many different types of supports may be used, as will be indicated hereinafter. Furthermore, although the connections at the opposite sides of the spacers, as described above, constitute the essence of the present invention, additional welds, staples, or other such fastening means, or even a solid line of fusion, may be provided throughout the spacers forming the base, to provide additional strength to the base as well as to increase the anchoring means. If desired, all of the spacer portions of the overlying bag units may be fused, welded, or otherwise made integral with each other to provide a strong and solid base for the pad of bag units. This strengthened base is especially preferred when the pad is to be dispensed while held in the hands without any additional support means.

It is, therefore, an important object of the present invention to provide a pad of multiple bag units, the bag units overlying each other and each bag unit comprising a pair of pockets which are in opposed relationship to each other and removably connected at their mouths to a common spacer therebetween, the overlying spacers being joined to each other to form a common base for each pocket, whereby when each pocket is grasped at the lip and pulled forwardly, it is simultaneously severed from the pad and fully opened.

Another object of the present invention is to provide a package or pad of plastic bags of the aforesaid type which is relatively easy and inexpensive to manufacture and easy to use.

Other objects and many of the attendant advantages of this invention will be readily appreciated as the same becomes better understood by reference to the following description when read in conjunction with the accompanying drawings wherein:

FIG. 1 is a perspective view of a pad of bag units embodying the present invention, the view being somewhat exploded to show an individual bag unit forming part of the pad assembly.

FIG. 2 is a somewhat enlarged fragmentary perspective view of the pad of FIG. 1, showing one pocket of the topmost bag unit in position just prior to being removed.

FIG. 3 is a fragmentary perspective view, similar to FIG. 2, but showing the topmost bag pocket being grasped and pulled away from the pad.

FIG. 4 is an exploded fragmentary perspective view showing a pad of bag units applied to a flat, rigid support or holder.

FIG. 5 is a fragmentary perspective view showing the use of a separate hanger for the pad, the hanger portion being insertable through a slit in the spacer base portion and the base of the hanger underlying the pad to provide central support.

FIG. 6 is a perspective view of a container or tray with the pad of bags therein, the container having an open top which may optionally be closed by a lid and being capable of being used either in the flat position or bent at its center to form a type of A-frame support for the pad, the pad being fastened at its spacer or base portion to the container, whereby the container serves as a dispenser for the bags.

FIG. 7 is a perspective view of a pad of bags connected to a cover sheet at its spacer or base portion, to form a book of bags when folded in half.

FIG. 8 is a fragmentary perspective view showing a pad with a plurality of welds throughout the spacer base portion to enhance the rigidity thereof.

FIG. 9 is a fragmentary perspective view, similar to FIG. 8, but showing a solid line of fusion in the spacer base portion.

Referring now in greater detail to the various figures of the drawings wherein similar reference characters refer to similar parts, there is shown in FIG. 1 a pad of bag units, generally designated 10, comprising a plurality of bag units 12, made of polyethylene or similar material, superimposed, one above the other.

Each bag unit 12 comprises a pair of pockets 14, each pocket being formed of a front wall, a rear wall and side edges sealing the two walls together around their entire peripheries except at the upper or mouth end. This mouth end is formed by a lip 16 constituted by the upper edge of the front wall which is lower then the upper edge of the rear wall, and by the upper edge of the rear wall which is defined by a tear or score line 18 which acts as a releasable attachment of the pocket to a spacer portion 20. The spacer 20 acts as a connection as well as separator between the two pockets 12 on either side thereof. When either of the topmost pockets 14 automatically forms a complete bag with an open mouth defined by the lip 16 and scored edge 18.

Ordinarily, when a pocket is grasped at the lip and pulled forwardly away from the pad, the mouth will tend to open at least partially, but due to the thermoplastic nature of the material there is a tendency for the walls to adhere to each other. As a result, although there is some opening of the mouth, the bag is severed from the pad while the walls are still adherent to each other. This necessitates a separate operation to pull the walls apart to completely open the bag.

In order to overcome the tendency for adherence of the bag walls to each other, all of the spacers 20 in the pad are integrally connected to each other by a common weld 22 at each side. These welds act as spaced anchors at the opposite sides of the unit so that, as the bag is pulled away, there is a reactive force applied at the welds 22, this forces the mouth to open wide and, as the pulling continues, forces the front and rear walls to separate sufficiently to open the bag ready for use. The fact that the welds are at opposite ends of the bag mouth increases the stretchability of the mouth and the opening force on the adhered walls. It is to be understood that although such welds as shown at 22 are preferred because of their complete integrating effect, other connecting means may be used such as clips, staples, adhesive, or the like.

FIG. 3 is illustrative of how the forward pull on the bag lip 16 sets up a counter-force at the welds 22 and since this counter-force is exerted at the opposite sides of the bag, the resultant vector force acts to open the bag mouth wide, which, as the force continues, acts to pull the front and rear walls of the bag away from each other.

FIG. 4 is illustrative of one type of mounting (when desired) for the pad. This mounting comprises a rigid or semi-rigid plate 30 having an upstanding lug 32 integrally or otherwise connected to its central portion. The pad, generally designated 34 has a central slot 36 in its spacer or base portion 38. The pad 34 is removably mounted on the plate 30 by lowering the pad in a manner to insert the lug 32 through the slot 36. The pad is then mounted in a supported flat position for use. When it is used up, another pad may be mounted on the plate in the same manner.

If desired, the plate 30 may be made semi-rigid, as of cardboard or the like, and, when so constructed, is adapted to be bent at its center so that it may act as an A-frame type of support or mounting wherein the pockets on either side are suspended from the base 38 but where the plate portions on either side still support the pockets.

The above type of selective A-frame support is also illustrated in FIGS. 5 and 6. In FIG. 5, there is shown a bar 40 having an upstanding lug 42 integral therewith. This lug 42 is insertable through a central slot 44 in the base portion 46 of the pad 48. The lug 42 is provided with an aperture 50 for insertion of a hook, cord, cable or any other desirable suspending means from which the pad may be hung. When so suspended, the bar 40 acts as a bottom support for the pad at the area below the base portion. Since the bar 40 is relatively narrow, when the pad is suspended by the lug 42, the opposite sides of the pad bend down around the bar 40 which acts as a flucrum.

In FIG. 6 there is shown a box tray 60 having an open top which may be closed by a removable lid (not shown) of any feasible type. The tray 60 may be constructed of any desirable material and the pad of bag units, designated generally 62, are inserted so they fill the tray. The pad 62 is stapled, as at 63, or otherwise secured to the container at the spacer or base portion. If desired, the tray 60 may comprise complete side walls 64 and end walls 66 and the assembly may be used flat like a box of facial tissues. However, as shown, the side walls 64 have a break or slot at the region of the spacer base 68 of the pad. With this construction, the tray shown in FIG. 6 may be used either flat, as described above, or may be bent around the spacer base area of the pad to form an A-type frame which may rest on a flat surface. In such instance, the side welds 70 act both for their above-described function and as a reinforcement for the transverse bend line 72 forming the fulcrum of the container. Although the tray is shown having side and end walls, it may also be a flat sheet.

FIG. 7 shows a foldable pad of bags 80 wherein the pad of bag units 82, such as described above, is stapled or otherwise secured at its center to a cover sheet 84. The staples are indicated at 86, but sewing, glueing or any other feasible securing means may be used. In this form of the device, the pad may be folded over like a billfold for easy carrying and use.

FIG. 8 shows a pad 90 of bag units such as described above, wherein, in addition to the side welds 92, there are provided a plurality of welds 94 extending throughout the spacer base portion 96. These welds 94 are shown as being arranged in two rows with the welds in one row being offset from those in the other row. This is considered preferable as providing a maximum of coverage with a minimum of welds; however whatever other arrangement is desirable may be used. This plurality of welds act as a strengthening means for the base portion. If desired, these welds may be replaced by staples, stitches, adhesive, or any other desirable and feasible connecting means for integrating the spacers with each other.

FIG. 9 shows a pad of bag units, generally designated 100 wherein the side welds are made integral with a complete, straight line of fusion 102 in the base porton 104. This provides a maximum degree of strength at the area of the fusion and also reinforces the side welds which are now integral therewith.

Obviously, various modifications of the present invention are possible in the light of the above teachings. It is, therefore, to be understood that, within the scope of the appended claims, the invention may be practiced otherwise than as specifically described.

The invention claimed is:

1. A pad of bags comprising a plurality of bag units in overlying relationship to each other, each bag unit comprising a pair of pockets, each pocket being in opposed relationship to the other on opposite sides of a spacer portion, each pocket having a front wall and a rear wall connected to each other at all of their peripheral edges except at a mouth portion, each mouth portion being defined by an edge of said rear wall which is releasably connected to said spacer portion and by an edge of said front wall forming a lip, and the spacer portions of all the bag units being integrally connected to each other by connections at their side edges to form a base portion for the pad, whereby said connections act as spaced anchors at the opposite sides of a bag unit upon opening of the mouth portion.

2. The pad of claim 1 wherein said bag units are constructed of thermoplastic material.

3. The pad of claim 1 wherein the connections between the spacer portions are side welds fusing the spacer portions to each other.

4. The pad of claim 1 wherein said spacer portions are additionally connected to each other by at least one additional connection intermediate their connections at their side edges.

5. The pad of claim 4 wherein the additional connection comprises a plurality of welds extending through the spacer portions.

6. The pad of claim 4 wherein the additional connection comprises a line of fusion between said spacer portions, said line of fusion extending from one side connection to the other.

7. The pad of claim 1 mounted on a flat support, said support having an upstanding lug and said base portion having a slot for receiving said lug.

8. The pad of claim 1 mounted on a support, said support comprising a bar extending transversely of said pad and longitudinally of said base portion, said bar having a lug extending laterally thereof, said base portion having a slot through which said lug extends, said support being adapted to act as a hanger means from which said pad is suspended.

9. The pad of claim 1 wherein said pad is flatly positioned in a tray, said tray having two sections, each of which is defined by a bottom wall, a front wall and side walls, said bottom walls being hingedly connected under the base portion of said pad and the side walls of one of sections being spaced from the side walls of the other section at the hinged connection, whereby said container may be selectively used as either a flat dispenser or an angled dispenser.

10. The pad of claim 9 wherein the pad is connected to the tray at the base portion of said pad.

* * * * *